United States Patent [19]

Byrd, Jr. et al.

[11] 4,341,916

[45] Jul. 27, 1982

[54] ELECTRIC FURNACE INSULATION MODULE

[75] Inventors: Carlisle O. Byrd, Jr.; Mack A. Hounsel, both of Houston, Tex.

[73] Assignee: Manville Service Corporation, Denver, Colo.

[21] Appl. No.: 202,360

[22] Filed: Oct. 30, 1980

[51] Int. Cl.[3] ..... H05B 3/66

[52] U.S. Cl. ..... 373/128

[58] Field of Search ..... 13/20, 25; 52/509, 475, 52/227

[56] References Cited

U.S. PATENT DOCUMENTS

| | | | |
|---|---|---|---|
| 3,892,396 | 7/1975 | Monaghan | 13/25 X |
| 3,952,470 | 4/1976 | Byrd, Jr. | 52/509 |
| 4,001,996 | 1/1977 | Byrd, Jr. | 52/509 |
| 4,055,926 | 11/1977 | Byrd, Jr. | 52/475 |
| 4,086,737 | 5/1978 | Byrd, Jr. | 52/227 |
| 4,088,825 | 5/1978 | Carr | 13/25 |
| 4,103,469 | 8/1978 | Byrd, Jr. | 52/509 |
| 4,123,886 | 11/1978 | Byrd, Jr. | 52/509 |
| 4,154,975 | 5/1979 | Sauder | 13/25 |
| 4,233,468 | 11/1980 | Northup, Jr. | 13/25 |
| 4,272,638 | 6/1981 | Cimochowski | 13/25 |

*Primary Examiner*—Roy N. Envall, Jr.

*Attorney, Agent, or Firm*—Robert M. Krone; Joseph J. Kelly

[57] ABSTRACT

Refractory fiber blanket blocks for electric furnaces having electrical heating elements mounted therewith by supports provide substantially improved insulation capabilities for electric furnaces when attached to the furnace walls. The support elements are in the form of holder members for receiving and support heating elements of the electric furnace and an arcuate spearing member which is capable of insertion into the insulative block at any desired location on an inner surface or hot face without requiring any anchoring structure for heating element support. The arcuate spearing member may take several forms and supports the heating element, engaging only the fiber blanket without anchoring structure for support.

60 Claims, 13 Drawing Figures

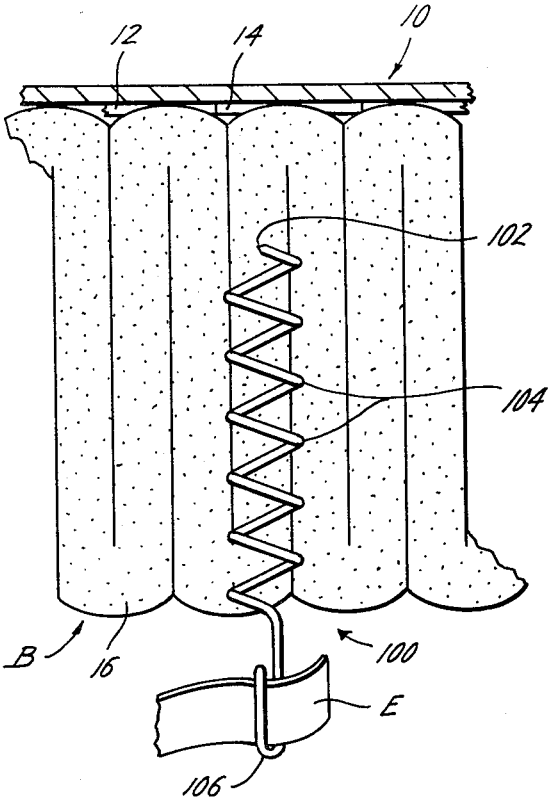
Fig. 8
Fig. 9
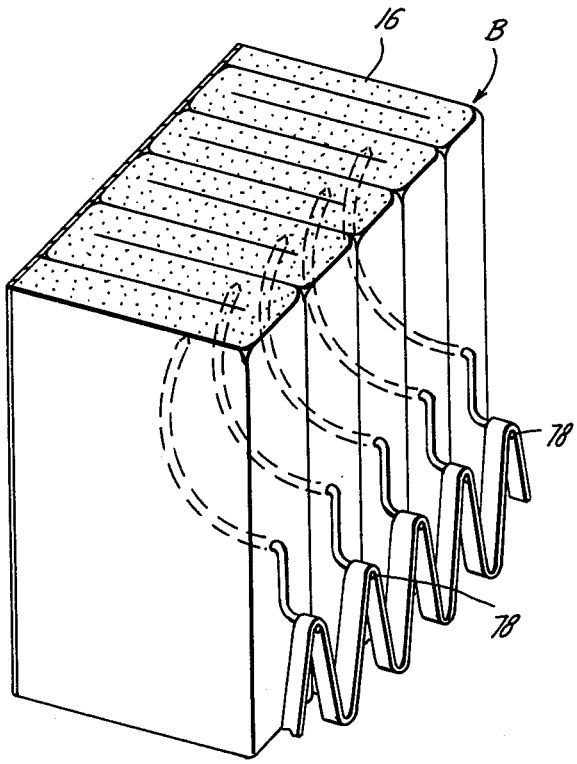
Fig. 10
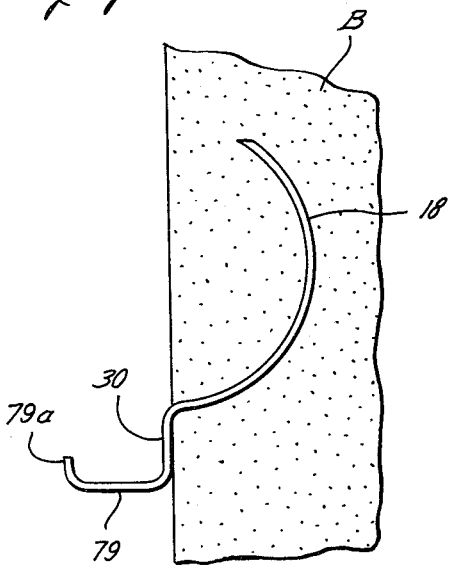

ELECTRIC FURNACE INSULATION MODULE

FIELD OF INVENTION

The present invention relates to modular refractory fiber blanket furnace insulation modules for electric furnaces.

DESCRIPTION OF PRIOR ART

U.S. Pat. No. 4,088,025 relates to an electric furnace wall construction insulated by an inner liner of plural compressibly stacked ceramic fiber slats or strips. Anchor members in the form of plates are placed between adjacent batts to support hanger spools for the electric heating element. The hanger spools are located at the inner surface or hot face of the module and are connected to the anchor member by support rods. With this structure, the anchors and rods, once positioned between adjacent batts, fix the location of the heating element support spools on the hot face, so that the spools cannot thereafter be moved without removing at least some of the modules. Because of the location of the anchors between batts, installation of the heater element support structure had to be performed as the insulation liner built-up by the progressive compression of securing of individual strips. Further, the location of the anchors between adjacent batts also made it difficult to modify an existing fiber lined fuel-fired furnace for use as an electric furnace.

U.S. Pat. No. 4,154,975 also relates to supports for electric heating elements in ceramic fiber insulated furnaces. To install this type of insulation module and support in an electric furnace, an anchor member was first positioned within the module, the module then attached to the furnace wall, and heating element support members then inserted into the module hot face to engage the anchor member. Again, the anchor member was required to be inserted into the module before the module could be installed in a furnace. This also made it difficult to convert other types of furnaces to electrical use and required special modules for electric furnaces. Also, the anchor member was placed between batts and transverse to the planes of the fiber strips, which did not take advantage of the structural strength of the strips for added support. Finally, because of the mortar and expanded metal attachment of these modules to the furnace wall, the weight carrying capacity of these electric furnace modules was limited.

Although U.S. Pat. Nos. 3,952,470; 4,001,996; 4,055,926; 4,086,737; 4,103,469 and 4,123,886 (of which one of applicants is inventor) relate to fiber blanket modules, they have in the past been limited in use, so far as is known, to fuel fired furnaces since no supports were provided on the hot faces of these modules for electric heating elements.

SUMMARY OF INVENTION

Briefly, the present invention relates to refractory fiber blanket insulation for electric furnaces. Refractory fiber blanket blocks having electrical heating elements mounted therewith by supports according to the present invention provide substantially improved insulation capabilities for electric furnaces when attached to the furnace walls.

The support elements aare in the form of holder members for receiving and supporting heating elements of the electric furnace and an arcuate spearing member which is capable of insertion into the insulative block at any desired location on an inner surface or hot face without requiring any additional anchoring structure for heating element support. The arcuate spearing member may take several forms and supports the heating element, engaging only the fiber blanket without anchoring structure for support.

With the present invention, refractory fiber blanket insulation modules are capable of use in either fuel fired furnaces or electric furnaces with no different internal structural features. Further, the location of the support elements on the hot face is not dictated by location of internal anchors in the module and may be varied as required for heating element position, permitting ease of heating element installation. This allows the arrangement of the modules and the electrical elements to be optimized independent of each other. Finally, if desired, a fiber blanket lined fuel fired furnace may be converted to an electric furnace with the present invention.

BRIEF DESCRIPTION OF THE DRAWINGS

FIGS. 4, 5, 7 and 10 are views, taken in cross-section, of other insulation modules of the present invention;

FIG. 8 is an elevation view, taken partly in cross-section, of an insulation module according to the present invention;

FIG. 9 is an isometric view of an insulating module according to the present invention;

DESCRIPTION OF PREFERRED EMBODIMENT

Figure 1:
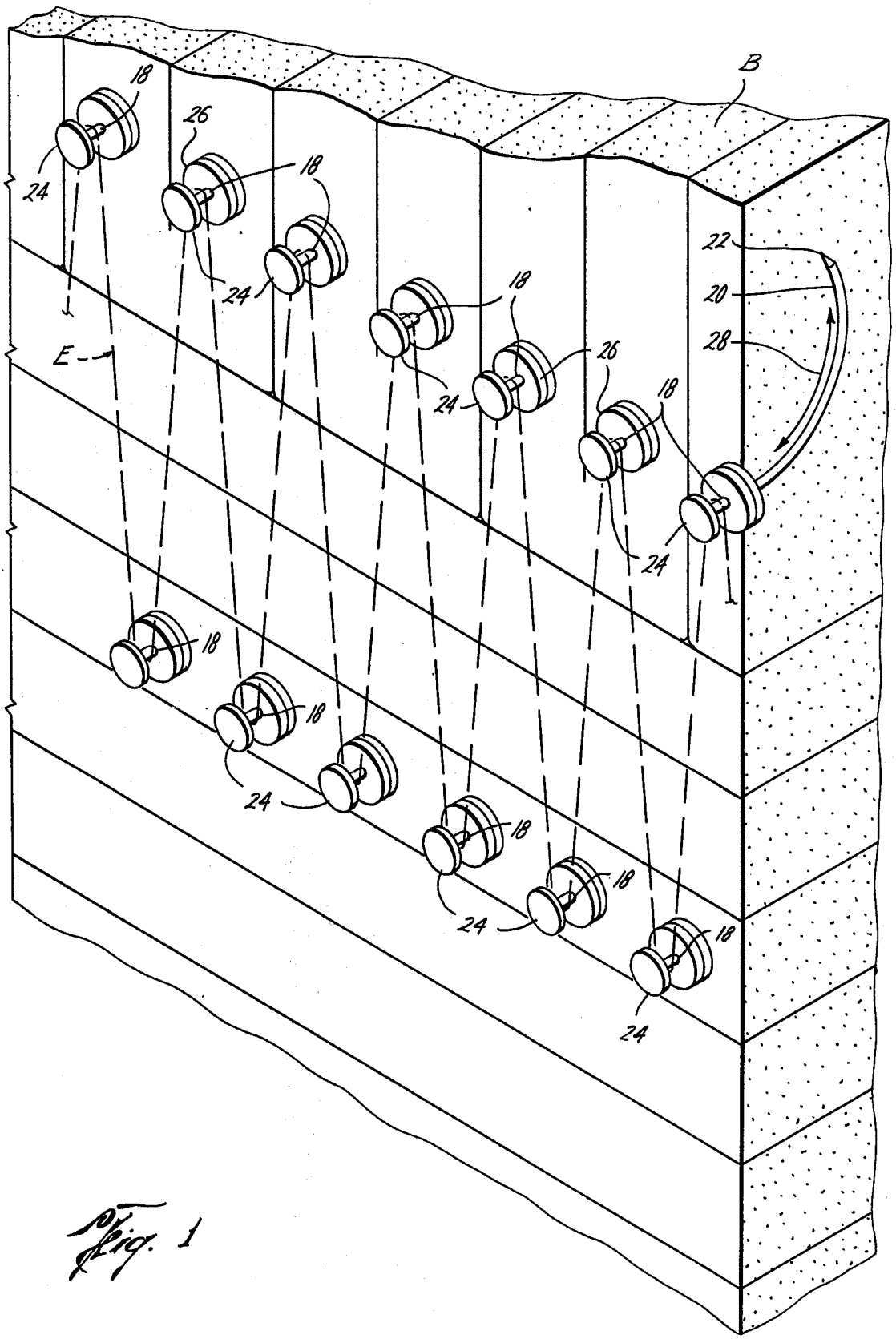
FIGS. 1 and 2 are isometric views, taken partly in cross-section, of insulation modules according to the present invention.
Figure 2:
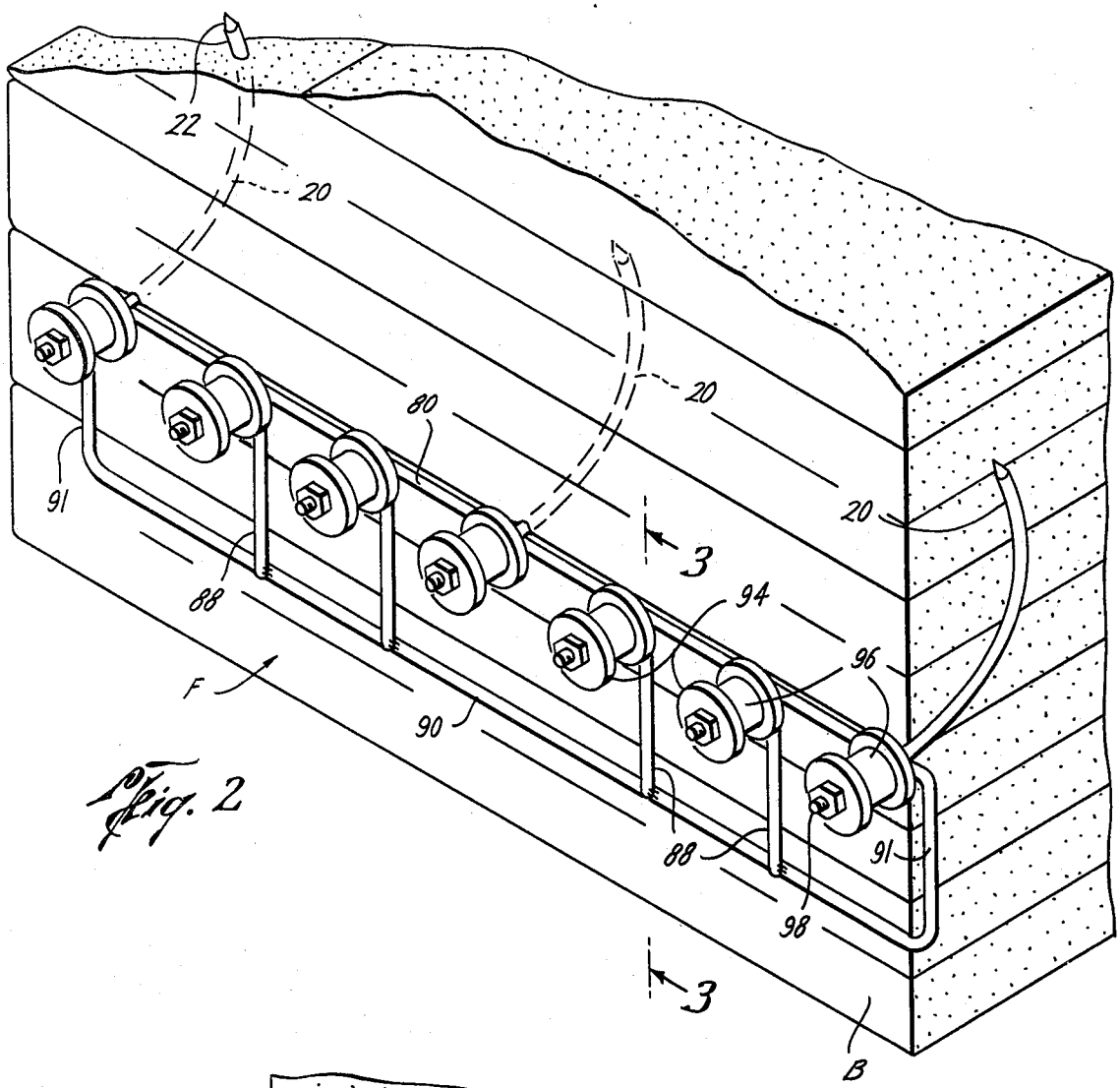
Figure 3:
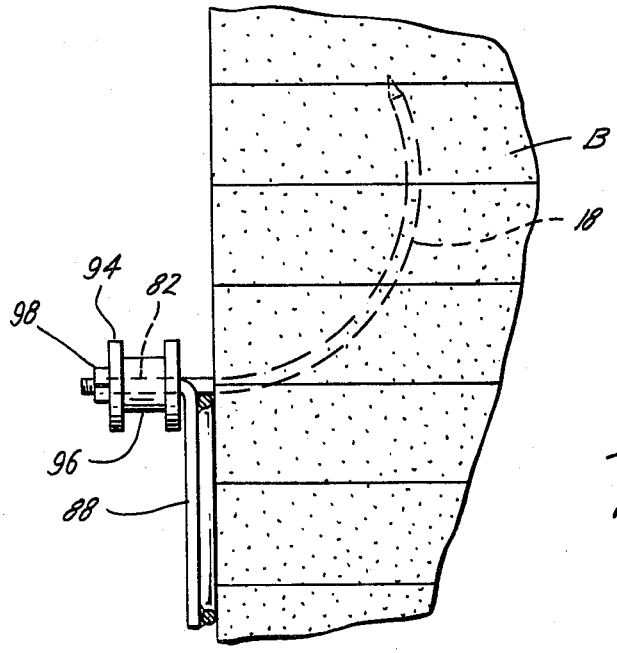
FIG. 3 is a cross-sectional view along the lines 3—3 of FIG. 2.
Figure 4:
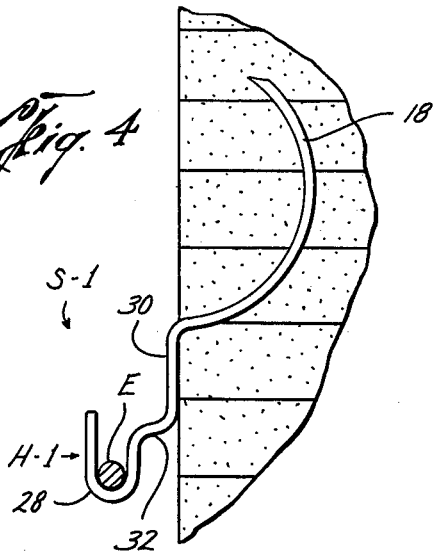
Figure 5:
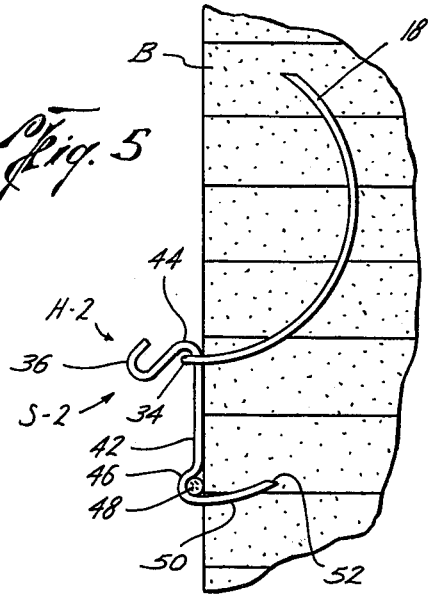
Figure 6:
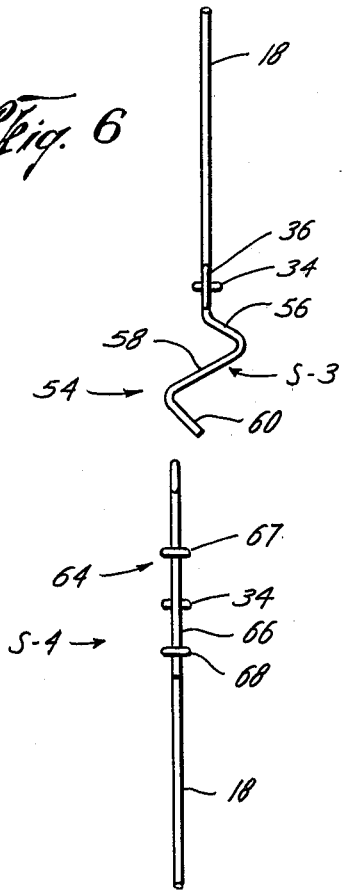
FIG. 6 is an elevation of support structure in the module of FIG. 7.
Figure 7:
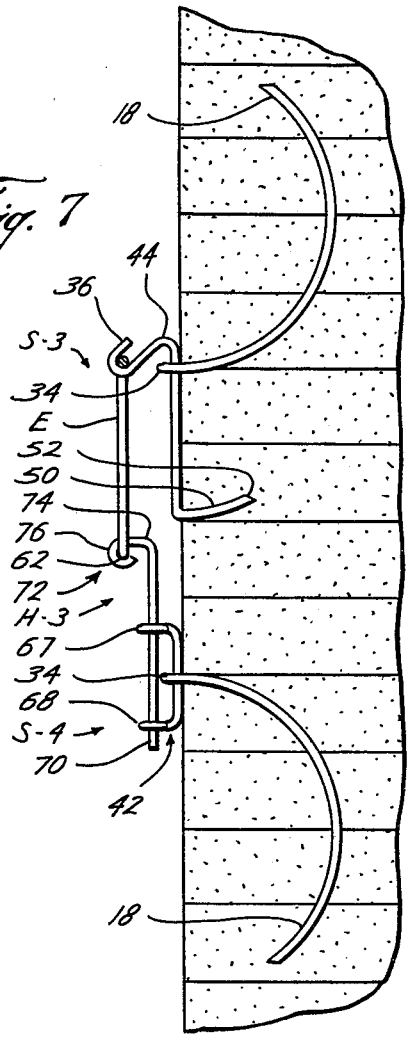

In the drawings, an insulating module M for attachment to an inner wall of an electric furnace to insulate the electric furnace is shown (FIGS. 1–5 and 7–9). The furnace may have either cylindrical or planar walls. As is typical, heat for the electric furnace is provided by an electric heating element E (FIGS. 1, 8 and 9). The heating element E is shown in phantom in FIG. 1, since in addition to the strip element shown in FIGS. 8 and 9, the heating element E may be of any suitable shape such as a rod (FIGS. 4 & 7), bar or strip. Usually, a number of heating elements E are provided to extend in an oscillating or sinous pattern across the walls of the furnace in the interior of the furnace to provide heat when electrical power is applied thereto. A number of modules M according to the present invention are installed to cover the inner walls of the electric furnace, preferably by being attached to an inner wall of the furnace by attachment structure 10 including a beam 12 and a channel member 14 in the manner set forth in U.S. Pat. Nos. 3,952,470 or 4,001,996. Further details of the attachment technique for the modules M of the present invention are set forth in such patents, which are incorporated herein by reference. It should be understood, however, that other attachment techniques could be used as well.

The module M includes a block B of refractory ceramic fiber blanket material which is preferably compressively stacked when installed and is formed from a strip of commercially available ceramic fiber sheets such as that sold under the trademark "Cerablanket" of the Johns-Manville Company, or other comparable material. In the preferred embodiment, the block B is formed from a continuous strip of serpentine folds or layers 16 extending between folds from the furnace wall to an inner surface, known in the art as the hot face, exposed to furnace interior conditions adjacent the heating element E. The blocks B may be mounted across the furnace wall so that the folds 16 extend horizontally, vertically, or in a parquet-like pattern. It should be understood that other forms of refractory fiber blocks of the type in U.S. Pat. Nos. 4,001,996; 4,055,926; 4,086,737; 4,103,469 and 4,123,866 may be used as well. Further, other refractory fiber installation techniques such as those in the form of edge grain or compressively stacked strips or batts, or other modular constructions could be used as well.

With the present invention, a support S for the electrical heating element E is mounted with the insulation module M. The support S includes a holder member H of various configurations (as will be set forth) for receiving and supporting the heating element E and arcuate spearing members P mounted with the holder member H for attaching the holder member H to the module M. As will be set forth in detail below, the spearing member P is of a structure and function such that it supports the holder member H on the module M independently of other supporting structure of the module M so that the holder member H may be located at any desired location on module M. As used with the present invention, arcuate is intended to mean that the spearing member subtends or occupies at least a portion of a circular arc. Thus, the portion of the arc occupied may be less than a semi-circular portion (FIGS. 1–7 and 9) of a curved hook-like member in a single plane or, alternatively, a multiplicity of 360° spirals in several vertical planes in the form of a coiled screw member (FIG. 8). With the structure of the present invention, no additional internal attachment supports or anchors are required for attaching electrical heating elements E to refractory ceramic fiber blocks B.

In first embodiment of the present invention (FIG. 1), the support S is in the form of a support rod member 18 formed at an outer end of an arcuate spearing hook or tine 20. Preferably, the spearing hook 20 has a pointed or spiked inner end 22 for ease of insertion into the fibers of the blanket B. A cap or upset head 24 is formed at an outer end of the support rod 18 in order to retain the electrical heating element E on the support rod 18. One or more insulating disks or washers 26 are provided, if desired, adjacent the inner face of the block B near the support rod 18 to provide an air space between the heating element E and the hot face of the block B.

For at least those supports for upper bends or folds of heating element E, the spearing hook 20 extends into the fibers of the block B in a direction opposite the force exerted on the support S by the weight of the heating element E. Where the module M is comprised of plural layers of refractory fiber blanket material, the spearing hook 20 extends through at least one layer of the blanket and may extend through more than one if desired. For lower supports, the direction in which the spearing hook 20 extends may vary.

For strength and to insure that the weight of the heating element E does not pull the support S from block B, it has been found that the spearing hook 20 should extend through or subtend an arc (indicated by an arrow 28) in the plane which the hook 20 occupies in the block B. Further, such arc should preferably be greater than ninety degrees, usually at least 120°. Such a configuration of the hook 20 causes the force of the weight of the heating element E on the hook 20 to force the inner end 22 of the hook 20 more deeply into the block B rather than tending to pull the hook 20 out of the block B. Hooks 20 occupying arc of approximately 150° have been found to be highly suitable for use according to the present invention.

The supports S of the embodiment set forth in FIG. 1 of the drawings are attached to the blocks B by being stabbed or inserted by hand or with some suitable tool at required locations, either before or after the block B is attached to the furnace wall. It is important to note that with the present invention, the locations of the support S on the block B is not mandated by the location of any internal supports or anchors in the blocks B, permitting flexibility as to the number and locations of the supports in accordance with the support requirements for the heating elements E.

With the present invention, the support S may take various shapes and sizes, dependent upon the type and weight of the heating element E. For example, a support S-1 (FIG. 4) is formed with a spearing member P having a support rod 18 of like construction to the embodiment of FIG. 1. A holding means H-1 in the form of an upwardly extending U-shaped loop 28 of a size adapted to receive a rod-shaped electric heating element E is also provided. The loop 28 is mounted at an outer end of the support rod 18 and connected thereto by a rib 30 and a spacer portion 32. The support rib 30 extends from the loop 28 along the hot face of the block B to increase support of the heating element E.

In a support S-2 (FIG. 5), a support rod 18 of like construction to that of the foregoing embodiments is used. A loop or eyelet 34 is formed at an end of the rod 18 adjacent the hot face for receipt of a holder member H-2. The holder member H-2 is in the form of an upwardly extending U-shaped loop 36 tilted inwardly towards the block B and of a size to receive the heating element E to be supported. The loop 36 is tilted inwardly for greater ease of retention of the heating element E on the hot face of the block B. The loop 36 is connected to a support rib 42 by a spacer elbow 44. The support rib 42 extends from the loop 36 to engage the hot face of the block B of the insulation module in order to increase support for heating elements. A lower portion of the support rib 42 bent into an inwardly facing hook shape is indicated at 46 in order that an insulative ceramic rod 48 formed from a suitable electrical insulating material, such as that known as mullite, may pass therethrough. In this manner, a number of supports S-2 may be interconnected across a face of the block B for additional strength to support heating elements while maintaining electrical insulative properties between adjacent such adjacent supports.

An attachment spear member 50 with a pointed inner end 52 for insertion into the fiber blanket of the block B is formed connected with the hook 46 at a lower end of the support rib 42. The spear member 50 is provided to furnish additional support on the support S-2 for the heating element E.

In a support S-3 (FIGS. 6 and 7) like structure to that of the support S-2 utilizes like reference numerals. In the support S-3, a support rib 54 extends across two planar dimensions of the hot face of the block B with an upper portion 56 thereof, intermediate portion 58 and a lower portion 60 interconnecting the attachment spear 50 with the eyelet or loop 36.

A lower support member S-4 (FIGS. 6 and 7) according to the present invention is especially adapted for supporting lower portions of heating elements E at lower bends or turns 62. The lower support S-4 includes a support rod 18 with an eyelet 34 of like structure to that of the support S-3. A yoke member 64 is mounted at a center portion 66 thereof by welding or other suitable techniques in the eyelet 34. The yoke member 64 also provides a function of a support rib. Upper and lower eyelet 67 and 68, respectively, are formed at opposite ends of the yoke 64 and receive a leg 70 of a holder member H-3. Preferably, the leg 70 is movably mounted in the eyelet 67 and 68 for raising upward and downward movement within such eyelets. A head member 72 of the H-3 includes a connector and spacer elbow 74 and a downwardly extending loop 76 which receives the lower bend 62 of the heating element E. The loop 76 preferably extends about a substantial portion of the external surface of the heating element E to retain such element in place on the block B.

It should be understood that any of the foregoing embodiments of the present invention may be adapted for use in situations where the heating element E is a strip member by changing the configuration of the holder member therewith so that it will receive and engage the heating element E being supported. For example, the support S-1 may be modified to receive a strap or strip heating element E by replacing the hook 28 thereof with an outwardly extending rod member 78, as shown in FIG. 9. Additionally, the support S-1 may be modified to serve as a support for strip heating elements by replacing the holder H-1 with an outwardly extending rod 79 having an upwardly extending head member 79*a* extending upwardly therefrom to form a U-shaped loop in conjunction with rib 30 for retaining the strip heating elements on the hot face of the block B.

Support members according to the present invention may further be assembled as a composite support member for ease of installation. In such situations (FIGS. 2 and 3), a suitable number of spearing hooks 20 are mounted with and interconnected by a connector rod 80 of a support frame member F. The hooks 20 preferably have supporting rods 18 of like structure to those of FIG. 1 formed therewith. Additional support rods 82 (FIG. 3) are mounted at spaced locations along the length of the connector rod 80 as required to support the heating element E. Each of the support rods 82 have a support rib 88 formed at an inner end and extending downwardly therefrom.

A lower connector rod 90 of the support member F is formed extending between outer most support ribs or rails 91 for additional support of the heating element E. Insulating spools 92 are provided to fit over the support rods 18 and 82.

The rods 18 and the support ribs 88 and support member F are formed from metal for strength and are thus electrically conductive material. The insulating spools 92 serve to prevent short circuits in these metal supports and have outer shoulders 94 which serve to retain the heating element E in place an inner cylindrical portion 96. The shape of the inner portion 96 may be varied according to the type of heating element to be supported. Nuts 98 or other suitable structure are formed and engage throughout the inner surfaces on the innermost ends of the supports rods 18 and 82 to retain the spools 92 on such support rods. A composite support member of the type set forth in FIGS. 2 and 3 of the drawings is installed in a like manner to be embodiment previously discussed.

A coiled screw spear 100 (FIG. 8) of the present invention also functions as an arcuate spearing member. The screw 100 is inserted into the block B at any desired location by inserting a pointed inner end 102 into the hot face of the block B and screwing the spear 100 into the block B with a suitable tool so that spiraled coils 104 enter into the layers of fiber blanket in the block B, attaching the spear 100 to the block B independently of any anchoring structure therein. An inwardly extending U-shaped loop 106 is formed as a holder member at an outer end of the screw 100 to support the heating element E when such heating element is in the form of a strip as shown in FIG. 8. Where other types of heating elements are to be supported according to the present invention, other types of holder members set forth with respect to other embodiments could as well be used.

For supporting an electric heating element, according to the present invention, on the hot face of an electric furnace roof lined with blocks B, a support member 110 and support member 112 are used at alternate loops or reversals of the heating element E across the refractory fiber block insulated furnace roof. As will be set forth below, the support 110 functions as a fixed support, while the support 112 serves as a sliding support, permitting the heating element E to expand with respect to the blocks B as electric power is applied to heat the interior of the furnace.

The fixed support member 110 includes an arcuate spearing member 114 adapted for insertion into the blocks B at a first end 116. For strength in supporting the heating element E, spearing member 114 is inserted so that a central portion 118 is located within the blocks B past the folds between adjacent layers. The end 116 preferably has a pointed tip for ease of insertion through the blocks B.

The spear 114, when installed, supports a rod member 120 extending between the end 116 and a second end 122 at a spaced position on a surface of the block. The rod member 120 has U-shaped loop 121 integrally formed at a central portion for receipt of the heating element E to support same on the roof of the furnace. An eyelet member 124 is formed at an end of the rod member 120 adjacent the end 116 of the spear member 114 so that the end 116 may be installed therethrough. The end 116 preferably has a threaded external surface so that a nut or other suitable mechanism may be attached thereto to join the rod member 120 and the spear 114 at one end. It should be understood, however, that other techniques for interconnecting two rods may be used, if desired. The end 122 of the spear 114 has an eyelet 126 formed therein so that an end portion 128 of the rod member 120 may be bent or folded thereabout after insertion therethrough to join the spear 114 and rod member 120 at an opposite end from the end 116.

In the sliding support member 112, like structure to that of the fixed support 110 performing like functions bears like reference numerals. In the sliding support member 112, a sliding U-shaped holder member 130 is attached by eyelets 132 to a transversely extending rod 134. The eyelets 132 are of sufficient size to permit the holder member 130 to move or slide along the rod 134 as the heating element E expands and contracts. The rod 134 is supported by an eyelet connection 124 on a spearing member 114 by a bolt 125 and supported by an eyelet member 126 at an end 122 of the spearing member 114.

Thus, it can be seen that the heating element E supported by the support members 110 and 112 suspend the heating element E below the refractory ceramic fiber blocks B lining the roof of the electric furnace. Further, as the electric heating element E expands upon application of electric power, the sliding support members 112 permit such expansion while supporting the heating elements E beneath the insulating blocks B.

Figures 11, 12, 13:
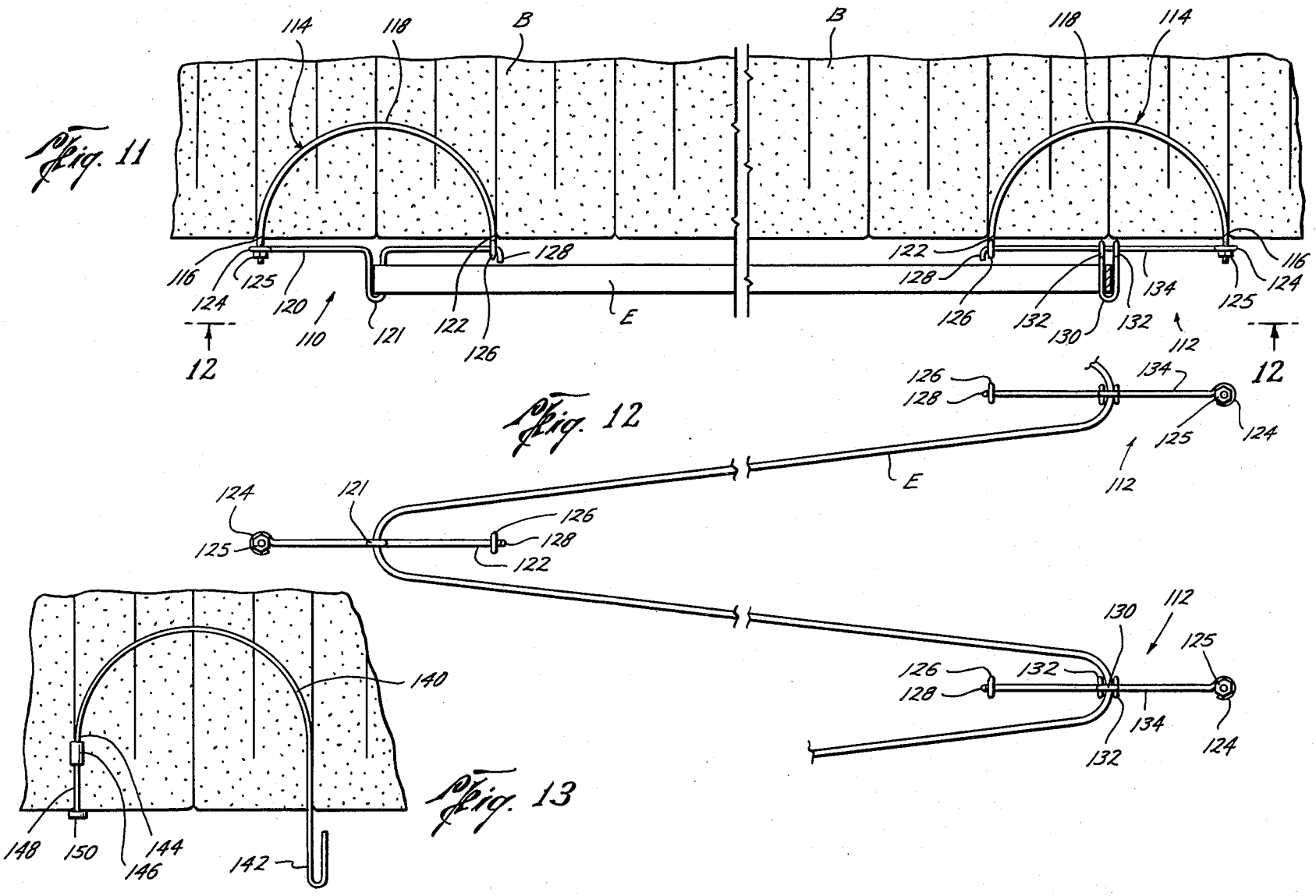
FIGS. 11 and 13 are elevation views of insulation modules for electric furnace roofs according to the present invention.
FIG. 12 is a view taken along the lines 12—12 of FIG. 11.

In an alternative roof support for electric heating elements (FIG. 13), an arcuate spearing member 140 having an U-shaped holder member 142 formed at an outer end thereof is inserted into the block B past the folds between adjacent strips. An inner end 144 of the spearing member 140 is adapted for interconnection with a connector sleeve 146. The connector sleeve 146 preferably has a socket formed therein for receipt of a threaded end of a rod 148. An enlarged head or disk portion 150 is formed at an outer end of the rod 148 so that forces which would tend to remove the spearing member 140 from the block B are resisted.

With the present invention, the support members are inserted into the fibers of the blocks B at desired locations on the hot face thereof, either before or after the blocks B have been attached to the furnace wall. As has been set forth above, the supports S may be attached at any desired location on the hot face of the blocks B, without requiring any internal anchors or supports in the block B. With the exception of the support S-4 of FIGS. 6 and 7, due to the movement permitted between leg 70 and eyelets 66 and 68, the remaining supports of the present invention may serve as upper supports. Each of the supports of the present invention may serve as lower supports.

After the blocks B have been installed across a sufficient area of the furnace wall with supports thereon at desired positions according to the shape and spacing between turns of the heating element E, the heating elements E may then be positioned on the supports. After installation, the supports S of the present invention are easily moved if the need arises and the heating elements E may be easily replaced and repaired.

During initial application of power to the heating element, it is not unusual for the cold heating elements to move and vibrate. In order to maintain the heating elements E on supports according to the present invention, it is desirable in these situations to spot weld the heating element E onto at least some of the supports when the heating elements are being installed. Since the heating elements expand as they become heated, spot welding to all supports may not be desirable. Further, with the present invention, since there are no internal interconnecting anchors required for the supports and the fiber in the insulation is resilient, the insulation acts as a vibration and movement damping mechanism or shock absorber as the elements move or vibrate on application of power and as the elements expand as their temperature increases. The fibers of the blanket also serve as electrical insulation. Thus, the electrical elements are isolated from the furnace shell for safety and the element supports of FIGS. 1 and 4 through 13 do not require additional structure to insulate adjacent supports from each other. Since the elements supports do not contact the furnace shell the blanket fibers also reduce the heat loss from the furnace by thermally isolating the elements and supports from the furnace shell.

In addition, if desired, the present invention may be utilized to convert a fuel fired furnace to an electric furnace. In such a situation, the blocks B of the fuel fired furnace have suitable supports, according to the present invention, inserted and attached thereto and heating elements E are then installed. Further, the present invention may be utilized by first installing as an inner veneered insulating lining, if desired, over an existing hard refractory lining in either an electric furnace for increased insulation or a fuel fired furnace for converting same to electric furnace use, and inserting the supports, according to the present invention, and then installing electric heating elements.

The foregoing disclosure and description of the invention are illustrative and explanatory thereof and various changes in the size, shape and materials as well as in the details of the preferred embodiment may be made without departing from the spirit of the invention.

We claim:

1. A product comprising:

(a) a block of refractory fiber blanket insulation material;

(b) an electric heating element;

(c) holder member means for supporting said electric heating element;

(d) arcuate spearing means mounted with said holder member means for attaching said holder member means to said block;

(e) said spearing means comprising means for supporting said holder member means on said module independently of other supporting structure wherein said holder member may be located at any desired location on said block; and (f) means for attaching said block to the inner wall of the electric furnace.

2. A product as in claim 1, wherein said arcuate spearing means comprises:

curved spearing hook means.

3. A product as in claim 1, wherein the insulation block is composed of plural layers of refractory fiber blanket and said arcuate spearing means comprises:

spearing hook means subtending an arc of at least one hundred twenty degrees through at least one of the layers of blanket when installed.

4. A product as in claim 1, wherein the insulation block is composed of plural layers of refractory fiber blanket said arcuate spearing means comprises:

spearing hook means subtending an arc of approximately one hundred fifty degrees through at least one of the layers of blanket when installed.

5. A product as in claim 1, wherein the insulation block is composed of plural layers of refractory fiber blanket said arcuate spearing means comprises:

spearing hook means subtending an arc of greater than ninety degrees through at least one of the layers of blanket when installed.

6. A product as in claim 2, wherein the insulation block is composed of plural layers of refractory fiber blanket said arcuate spearing means comprises:

coiled screw means adapted for boring insertion into at least one layer of the blanket.

7. A product as in claim 1, further including:

means for electrically insulating said holder member means from electric heating element.

8. A product as in claim 1, wherein said holder member means comprises:

(a) support member means for suspending the electric heating element thereon; and (b) head means for retaining the electric heating element on said support member means.

9. A product as in claim 8, wherein said head means comprises:

a cap member formed at an opposite end of said holder support means from said arcuate spearing means.

10. A product as in claim 9, wherein said cap comprises:

a head member integrally formed with said support member means.

11. A product as in claim 10, wherein said head member comprises:

an upwardly extending loop mounted at an outer end of said support member means.

12. A product as in claim 10, wherein said head member comprises:

a downwardly extending loop mounted at an outer end of said support member means.

13. A product as in claim 10, wherein said head member comprises:

an inwardly extending loop mounted at an outer end of said support member means.

14. A product as in claim 8, wherein said support member means comprises:

a support rod.

15. A product as in claim 8, wherein said support member means comprises:

a support spool.

16. A product as in claim 15, wherein said head means comprises:

shoulder members formed on said support spool.

17. A product as in claim 15, further including:

means for attaching said support spool to said arcuate spearing means.

18. A product as in claim 1, wherein said holder member means includes:

an attachment spear member for insertion into the module for additional support of the heating element.

19. A product as in claim 1, wherein said arcuate spearing means comprises:

a plurality of attachment spears.

20. A product as in claim 1, wherein the heating element is sinuously folded electrical heating element said holder member means comprises:

a plurality of spaced holder members for receiving adjacent loops of the heating element.

21. A product as in claim 20, further including:

means for electrically insulating said plurality of spaced holder members from each other.

22. A product as in claim 1, further including:

support rib means extending from said holder member means for engaging a face of the insulation block for increased support of the heating element on the module.

23. A product as in claim 22, wherein the insulation block has an inner hot face for exposure to furnace conditions and said support rib means comprises:

means for engaging the face of the insulation block across portions of the hot face of the insulation block.

24. A product as in claim 1 wherein said spearing means extends through said insulation block from a first end of a surface of the block to a second end at a spaced position on a surface of the block.

25. A product as in claim 24, wherein said holder member means comprises:

(a) a rod member extending between and connected to said first and second ends of said spearing means;

(b) holder means with said rod member for suspending the heating element beneath said rod member.

26. A product as in claim 25 wherein said holder means is integrally formed with said rod member.

27. A product as in claim 25 wherein said holder means is movably mounted with said rod member.

28. A product as in claim 24, wherein said holder member comprises:

a loop member formed at a first end of said spearing means.

29. A product as in claim 1 wherein:

(a) said holder means also includes means for receiving said electric heating element.

30. In an electric furnace, an insulative lining for insulating an inner wall of the furnace, comprising:

(a) an insulative layer of refractory fiber blanket insulation material;

(b) an electric heating element;

(c) holder member means for receiving and supporting said electric heating element;

(d) arcuate spearing means mounted with said holder member means for attaching said holder member means to said insulative layer;

(e) said spearing means comprising means for supporting said holder member means on said insulative layer independently of other supporting structure wherein said holder member may be located at any desired location on said layer; and (f) means for attaching said layer to the inner wall of the electric furnace.

31. The lining of claim 30, wherein said insulative layer comprises:

a module of refractory fiber blanket insulation material.

32. The lining of claim 30, wherein said insulative layer comprises:

a plurality of compressively stacked strips of refractory fiber blanket insulation material.

33. A support for an electric heating element for an insulation module in a refractory fiber blanket furnace lining system, comprising:

(a) an electric heating element;

(b) holder member means for receiving and supporting said electric heating element;

(c) arcuate spearing means mounted with said holder member means for attaching said holder member means to the module; and (d) said spearing means comprising means for supporting said holder member means on said module independently of other supporting structure wherein said holder member may be located at any desired location on the module.

34. The support of claim 33, wherein said arcuate spearing means comprises:

curved spearing hook means.

35. The support of claim 33, wherein the insulation module is composed of plural layers of refractory fiber blanket said arcuate spearing means comprises:

spearing hook means subtending an arc of at least one hundred twenty degrees through at least one of the layers of blanket when installed.

36. The support of claim 33, wherein the insulation module is composed of plural layers of refractory fiber blanket said arcuate spearing means comprises:

spearing hook means subtending an arc of approximately one hundred fifty degrees through at least one of the layers of blanket when installed.

37. The support of claim 33, wherein the insulation module is composed of plural layers of refractory fiber blanket said arcuate spearing means comprises:

spearing hook means subtending an arc of greater than ninety degrees through at least one of the layers of blanket when installed.

38. The support of claim 33, wherein the insulation module is composed of plural layers of refractory fiber blanket said arcuate spearing means comprises:

coiled screw means adapted for boring insertion into at least one layer of the blanket.

39. The support of claim 33, further including:

means for electrically insulating said holder member means from said electric heating element.

40. The support of claim 33, wherein said holder member means comprises:

(a) support member means for suspending said electric heating element thereon; and (b) head means for retaining the electric heating element on said support member means.

41. The support of claim 40, wherein said head means comprises:

a cap member formed at an opposite end of said holder support means from said arcuate spearing means.

42. The support of claim 41, wherein said cap comprises:

a head member integrally formed with said support member means.

43. The support of claim 41, wherein said head member comprises:

an upwardly extending loop mounted at an outer end of said support member means.

44. The support of claim 42, wherein said head member comprises:

a downwardly extending loop mounted at an outer end of said support rod means.

45. The support of claim 42, wherein said head member comprises:

an inwardly extending loop mounted at an outer end of said support member means.

46. The support of claim 40, wherein said support member means comprises:

a support rod.

47. The support of claim 40, wherein said support member means comprises:

a support spool.

48. The support of claim 47, wherein said head means comprises:

shoulder members formed on said support spool.

49. The support of claim 47, further including:

means for attaching said support spool to said arcuate spearing means.

50. The support of claim 33, wherein said holder member means includes:

an attachment spear member for insertion into the module for additional support of the heating element.

51. The support of claim 33, wherein said arcuate spearing means comprises:

a plurality of attachment spears.

52. The support of claim 33, wherein the heating element is a sinuously folded electrical heating element said holder member means comprises:

a plurality of spaced holder members for receiving adjacent loops of the heating element.

53. The support of claim 52, further including:

means for electrically insulating said plurality of spaced holder members from each other.

54. The support of claim 33, further including:

support rib means extending from said holder member means for engaging a face of the insulation module for increased support of the heating element on the module.

55. The support of claim 54, wherein the module has an inner hot face for exposure to furnace conditions and said support rib means comprises:

means for engaging the face of the insulation module across portions of the hot face of the module.

56. The support of claim 33, wherein said spearing means extends through said module from a first end on a surface of the module to a second end at a spaced position on a surface of the module.

57. The support of claim 56, wherein said holder member means comprises:

(a) a rod member extending between and connected to said first and second ends of said spearing means; and (b) holder means with said rod member for suspending the heating element beneath said rod member.

58. The support of claim 56, wherein said holder means is integrally formed with said rod member.

59. The support of claim 56, wherein said holder means is movably mounted with said rod member.

60. The support of claim 55, wherein said holder member comprises:

a loop member formed at a first end of said spearing means.

* * * * *